US010041278B2

(12) United States Patent
Zappa

(10) Patent No.: US 10,041,278 B2
(45) Date of Patent: Aug. 7, 2018

(54) BLOCK SYSTEM AND ASSEMBLY FOR LIFT DOORS

(71) Applicant: Wittur Holding GmbH, Bayern (DE)

(72) Inventor: Roberto Zappa, Bergamo (IT)

(73) Assignee: Wittur Holding GmbH, Bayern (DE)

( * ) Notice: Subject to any disclaimer, the term of this patent is extended or adjusted under 35 U.S.C. 154(b) by 120 days.

(21) Appl. No.: 15/127,402

(22) PCT Filed: Feb. 11, 2015

(86) PCT No.: PCT/IB2015/051023
§ 371 (c)(1),
(2) Date: Sep. 19, 2016

(87) PCT Pub. No.: WO2015/140652
PCT Pub. Date: Sep. 24, 2015

(65) Prior Publication Data

US 2017/0130486 A1 May 11, 2017

(30) Foreign Application Priority Data

Mar. 19, 2014 (IT) ..... BS2014A0063

(51) Int. Cl.
*E05B 65/08* (2006.01)
*B66B 13/06* (2006.01)
(Continued)

(52) U.S. Cl.
CPC ..... *E05B 65/08* (2013.01); *B66B 13/06* (2013.01); *B66B 13/12* (2013.01); *B66B 13/24* (2013.01);
(Continued)

(58) Field of Classification Search
CPC ..... E05B 65/08; E05B 19/00; E05B 65/0858; E05B 65/087; E05B 15/06; B66B 13/06; B66B 13/12; B66B 13/24; B66B 13/30
See application file for complete search history.

(56) References Cited

U.S. PATENT DOCUMENTS 4,676,537 A * 6/1987 Esser ..... E05B 55/12 292/341.15
4,947,964 A * 8/1990 Husmann ..... B66B 13/12 187/314
(Continued)

FOREIGN PATENT DOCUMENTS

CN 201056450 Y 5/2008
CN 201756393 U 3/2011
(Continued)

OTHER PUBLICATIONS

International Search Report in PCT/IB2015/051023 dated May 7, 2015.
(Continued)

*Primary Examiner* — Michael A Riegelman
(74) *Attorney, Agent, or Firm* — Henry F. Cittone; Cittone Demers & Arneri LLP

(57) ABSTRACT

Locking system (10) for a sliding door (2) with respect to a constraint structure comprising a latch (4), associable to the sliding door (2) or to the constraint structure, rotatable or rotatably translatable between a configuration of locking and a configuration of release of the door (2), a keyhole member (6), connectable to the other between the constraint structure or the sliding door (2), which delimits a holding edge (8) that, in the locking configuration, is engaged by the latch (4) to prevent movement of the, sliding door (2) with respect to said structure, the keyhole member (6) being manually
(Continued)

operable to move the holding edge (8) and the latch (4) apart, when the latter is in the locking configuration.

14 Claims, 3 Drawing Sheets

(51) Int. Cl.

| | |
|---|---|
| ***B66B 13/12*** | (2006.01) |
| ***B66B 13/30*** | (2006.01) |
| ***B66B 13/24*** | (2006.01) |
| ***E05B 19/00*** | (2006.01) |
| ***E05D 15/06*** | (2006.01) |

(52) U.S. Cl.
CPC ..... *B66B 13/30* (2013.01); *E05B 19/00* (2013.01); *E05B 65/087* (2013.01); *E05B 65/0858* (2013.01); *E05D 15/06* (2013.01)

(56) References Cited

U.S. PATENT DOCUMENTS

| | | | | |
|---|---|---|---|---|
| 5,246,089 | A * | 9/1993 | Husmann | B66B 13/12 187/319 |
| 5,730,254 | A | 3/1998 | Nguyen | |
| 5,819,877 | A * | 10/1998 | Rivera | B66B 13/12 187/314 |
| 6,021,871 | A * | 2/2000 | Grabner | B66B 13/12 187/335 |
| 6,446,759 | B1 * | 9/2002 | Kulak | B66B 13/12 187/319 |
| 9,637,350 | B2 * | 5/2017 | Mittermayr | B66B 13/12 |
| 9,663,329 | B2 * | 5/2017 | Zappa | B66B 13/12 |
| 9,834,413 | B2 * | 12/2017 | Mittermayr | B66B 13/12 |
| 2005/0126861 | A1 * | 6/2005 | Bisang | B66B 13/12 187/319 |
| 2005/0139429 | A1 * | 6/2005 | Bisang | B66B 13/12 187/319 |
| 2006/0107785 | A1 * | 5/2006 | Zappa | B66B 13/20 74/612 |
| 2007/0200370 | A1 * | 8/2007 | Reithmeyer | E05B 63/18 292/340 |
| 2008/0000727 | A1 * | 1/2008 | Dziwak | B66B 13/12 187/319 |
| 2011/0186386 | A1 * | 8/2011 | Gilli | B66B 13/12 187/324 |
| 2012/0118676 | A1 * | 5/2012 | Utsunomiya | B66B 13/12 187/330 |
| 2015/0203329 | A1 * | 7/2015 | Zappa | B66B 13/125 187/319 |

FOREIGN PATENT DOCUMENTS

| | | | |
|---|---|---|---|
| CN | 103612966 | A | 3/2014 |
| WO | 2013190578 | A1 | 12/2013 |

OTHER PUBLICATIONS

Italian Search Report in IT10214902244150 dated Jun. 6, 2014.
Written Opinion of the International Searching Authority in PCT/IB2015/051023 dated Sep. 24, 2015.
Search Report in Chinese Application No. 2015800144528 dated Jan. 22, 2018.

* cited by examiner

BLOCK SYSTEM AND ASSEMBLY FOR LIFT DOORS

CROSS-REFERENCE TO RELATED APPLICATIONS

This application is the U.S. national stage of PCT International Patent Application No. PCT/IB2015/051023, filed Feb. 11, 2015, which claims priority to Italian Patent Application No. BS2014A000063, filed Mar. 19, 2014, the disclosures of each of which are incorporated herein by reference in their entirety.

The present invention relates to a locking system for a sliding door, and an assembly comprising such a system.

It is known that a sudden power failure can lead to difficulties in removing passengers from the cabin of a lift apparatus.

Independently of the fact that the lift doors may be misaligned with respect to the landing doors, the moving means for opening/closing of the doors are electrically locked and powered, so it may not be possible to free the passengers until the electric current is at least temporarily restored.

This invention addresses to this context, proposing to provide an emergency system for unlocking the doors of a lift system, designed so as to allow emergency responders (such as the fire department) to forcibly open the doors to remove or rescue the passengers of the cabin.

This objective is achieved by means of a locking system according to claim 1, and by means of an assembly according to claim 9. The claims dependent on these show variants of preferred embodiments.

The object of this invention will now be described in detail, with the help of the attached tables, wherein.

With reference to the above-referenced tables, reference number 1 identifies in its entirety a locking assembly that comprises at least one sliding door 2, constraint structure and a locking system 10, described below, functionally connected to the sliding door 2 and to the constraint structure.

In this description, the term "constraint structure" refers to a structure that, by cooperating with the locking system 10, holds the sliding door 2 in a default position. For example, the default position may be a position of at least partial closure of an internal compartment of a cabin-lift or a vertical shaft of a lift system.

In fact, the locking system object of this invention could be used to constrain a landing leaf/door, but more preferably it is used for a cabin leaf/door.

Purely by way of example, the constraint structure could be a side post, an opposite door 2', a translation guide 38, 38' of said door or the like.

Figure 5:
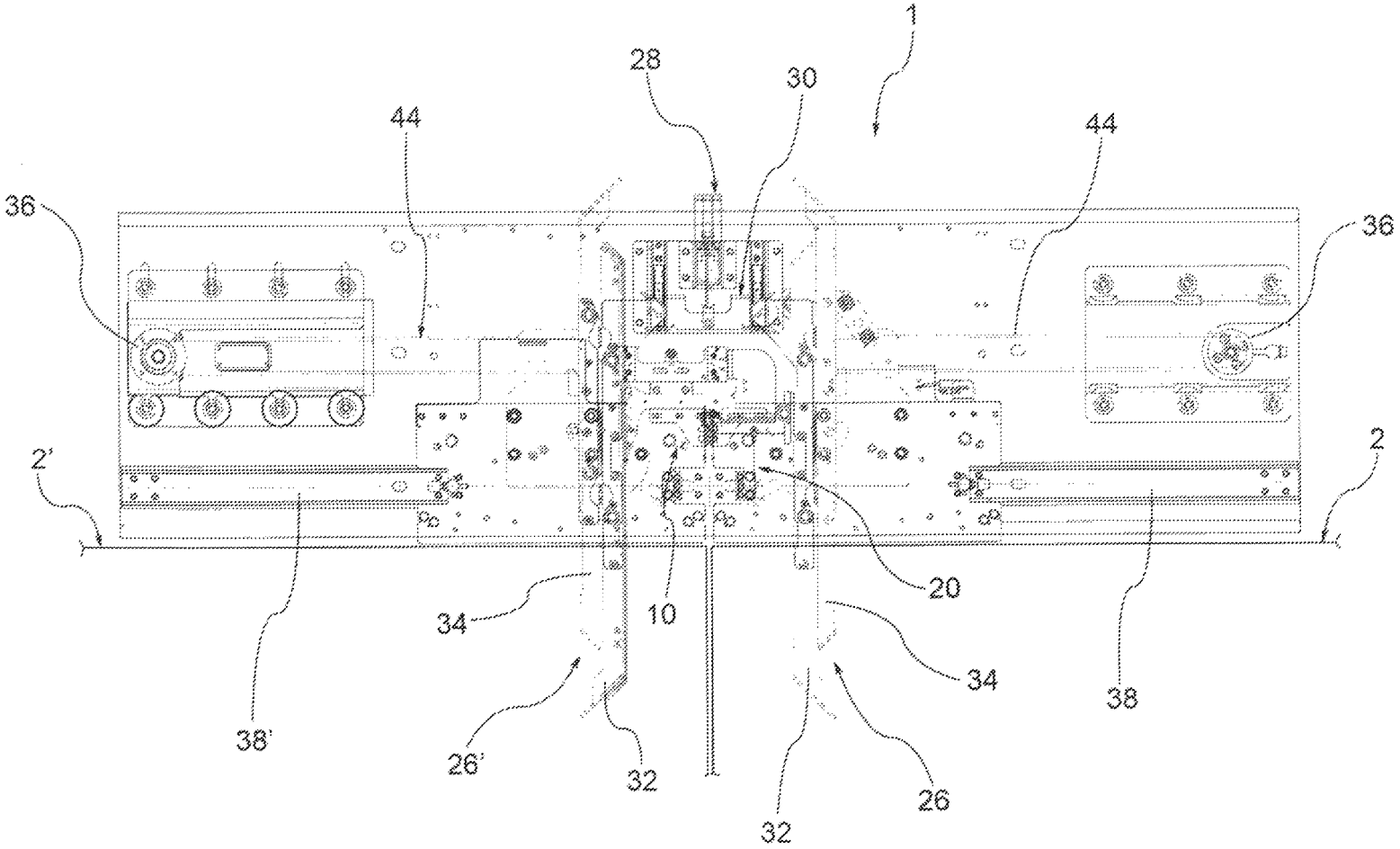
FIG. 5 shows a view of a locking assembly, employing the system of FIG. 1, according to a possible embodiment.

For the variant with an opposite door 2', shown schematically in FIG. 5, the assembly 1 therefore comprises a pair of centrally opening sliding doors 2, 2'.

Preferably, the assembly 1 comprises at least one translation guide 38, 38' (such as a rail) that guides the movements of the door 2, 2' between its different operating modes.

According to a variant, the assembly 1 comprises first moving means 36 for moving the sliding door 2 and a slide 26, 26' associated thereto from an abutment position of the door 2 with the side post (or with the opposite door 2'), to a separation position from said post (or from said opposite door 2').

Advantageously, the moving means can comprise at least one electric motor, operatively connected to the door (or to the plurality of doors 2, 2') through first transmission means 44.

According to an embodiment, the first transmission means—which connect the sliding door 2 to the first moving means—can comprise a belt connected to the sliding door 2 so as to move it between the positions described, for example in opening and closing of the internal compartment. Analogous first transmission means could also be provided for the opposite door 2'.

According to an advantageous embodiment, the assembly comprises at least one slide 26, 26', translatably movable together with the sliding door 2 and configured for cooperating with a lock of a landing door (not shown) to allow an opening of the latter.

In other words, the slide 26, 26' works on a landing lock (for example on a pair of actuating rollers of such a lock adjacent to the slide) to unlock the related landing door, so as to coordinate or couple the movements of the sliding door 2 and the landing door.

According to a further embodiment, second moving means 28, preferably independent of the first moving means 36, act on a locking/unlocking trolley 30 of the slide by means of a kinematic coupling of the irreversible type.

In this description, the term "irreversible coupling" means a mechanical connection that cannot be reversed except through the application of an electric current to the second motor means 28. It follows that, in the absence of electric current, the locking/unlocking trolley 30 remains in the same position even under the action of external influences (such as a manual action).

Figure 1:
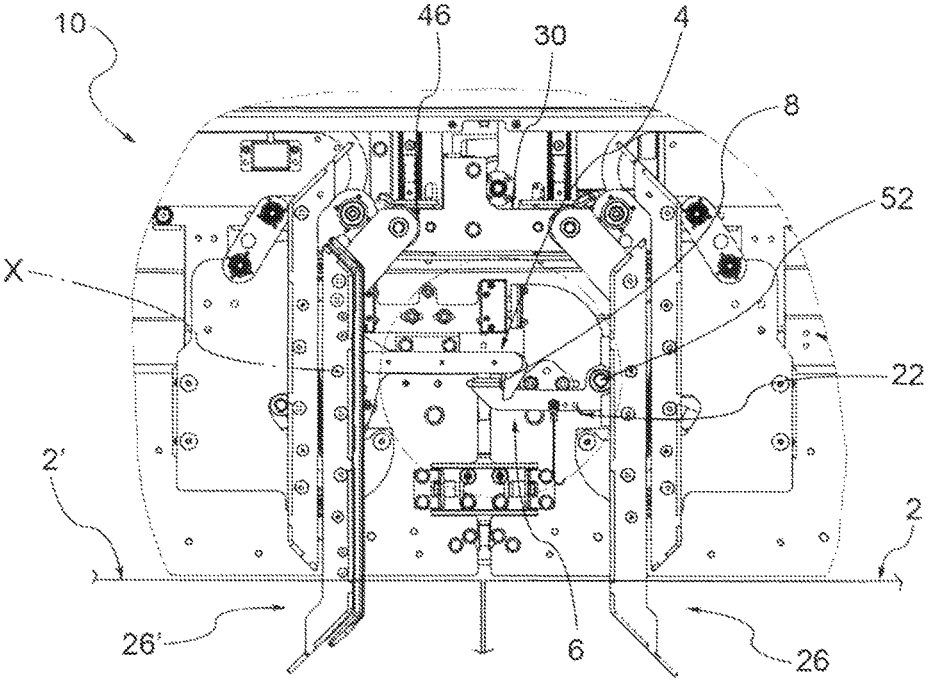
FIGS. 1 and 2 show frontal views of a locking system object of this invention, according to a possible embodiment, mounted in the assembly in two different operating configurations.

As it can been seen for example from FIG. 1, the slide 26, 26' comprises at least one constraint element (for example a wheel or roller), on which the locking/unlocking trolley 30 works. In this way, the blades 32, 34 of the slide 26, 26' are maintained in reciprocal approach. Preferably, the trolley 46 acts in thrust to maintain this approaching.

When, on the contrary, the locking/unlocking trolley 30 releases the constraint element 46, the slide blades 32, 34 will be free to move away in order to work on the landing lock. For example, this release occurs by means of the locking/unlocking trolley 30 moving away from the sliding door.

Preferably, the slide blades 32, 34 are constantly pushed away by elastic means 48 acting between them (such means being just visible in FIG. 2), in opposition to the action of the locking/unlocking trolley 30.

According to a variant, the second moving means 30 can comprise at least one electric motor and, optionally, such means could be connected to the trolley 30 through second transmission means. For example, the second transmission means may comprise a shaft and a pinion of the second motor means 30, such pinion meshing with a transmission rack associated to the locking/unlocking trolley 30.

As said, the slide 26, 26' preferably comprises a pair of slide blades 32, 34, which can be brought together and separated in an articulated manner (preferably in a roto-translatable manner), in particular through not shown levers.

For variants that provide for the opposite door 2', a locking/unlocking trolley 30 could be provided in parallel on a slide 26, 26' of each of these doors.

The locking system 10 of the sliding door 2 with respect to the constraint structure, comprises a latch associated to the door 2 or to the constraint structure, rotatable about a primary rotation axis X (or roto-translatable, according to another embodiment), between a locking configuration and a release configuration of the door 2.

Preferably, the latch 4 comprises at least one hooking portion 42, for example an end portion shaped in this way.

According to an advantageous embodiment, the latch 4 delimits a cam-shaped front surface 40, whose function will be clarified below. For example, the front surface extends in a direction inclined with respect to a prevailing extension direction of the latch.

According to a further embodiment, the movement of the latch 4 is controlled (or coordinated) by the movement of at least one of the slide blades 32, 34.

The locking system 10 comprises also a keyhole member 6, connected to the other between the constraint structure or the sliding door 2, delimiting a holding edge 8 that, in the locking configuration, is engaged by the latch 4 to prevent the sliding door 2 from moving relative to the structure.

In other words, as long as the latch 4 (and in particular the related hooking portion 42) interferes with the holding edge 8, the sliding door 2 and the constraint structure are forced to remain in substantially the same relative position.

Advantageously, the latch 4 and the keyhole member 6 are secured in correspondence to the respective slides 26, 26' associated to adjacent doors 2, 2'.

According to the embodiment shown in the tables, the keyhole member 6 comprises a moving/rotatable shaft 16, at one end of which a transversal component 18 is secured that delimits a part of the holding edge 8.

For example, the transversal component 18 has a generally plate-like shape.

Figure 4:
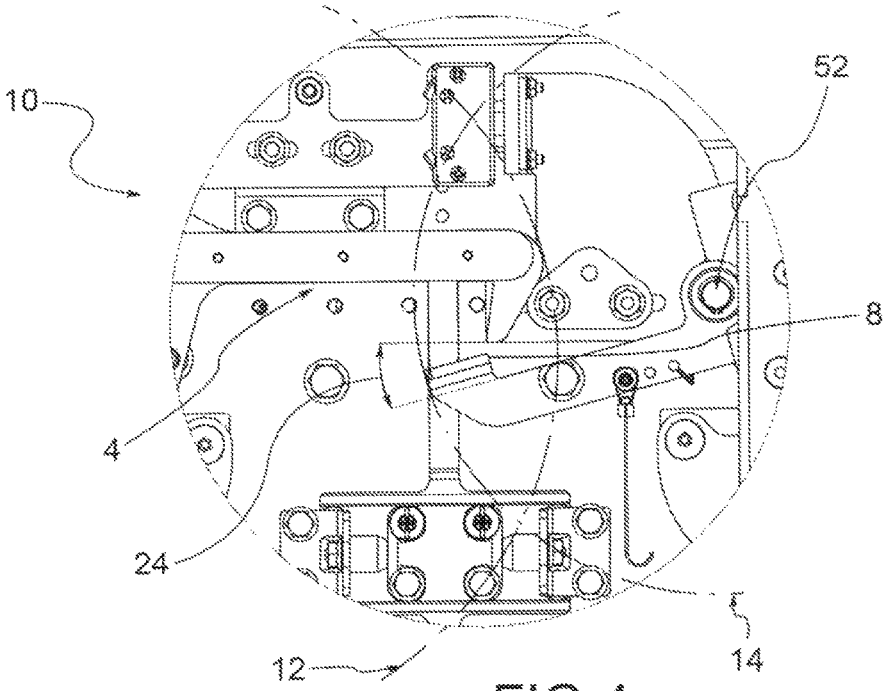

The keyhole member 6 is innovatively manually operable to distance the holding edge from the latch 4 (as shown, for example, in FIGS. 2 and 4), when the latter is in the locking configuration.

In this way, through the disengagement of the holding edge 8 from the latch 4 with a manual intervention, it is possible to reciprocally free the sliding door and the constraint structure.

For this reason, even in the presence of a kinematic coupling of the irreversible type of the first and/or second moving means, the system that is object of this invention allows to unlock the movement of the sliding door.

Advantageously, the keyhole member 6 is rotatably actuable about a secondary rotation axis Z substantially parallel to the primary rotation axis X.

According to a further advantageous embodiment (as for example shown in FIG. 4), the keyhole member 6 is rotatable relative to the constraint structure or relative to the sliding door 2, wherein one first arc trajectory 12 of said member overlaps at least in projection a second arc trajectory 14 travelled by the latch 4.

According to a variant, the locking system 10 comprises manual actuating means 20—for example a cord, chain or manoeuvring rod that acts on the moving/rotatable shaft 16 to disengage the holding edge 8 from the latch 4.

Figure 2:
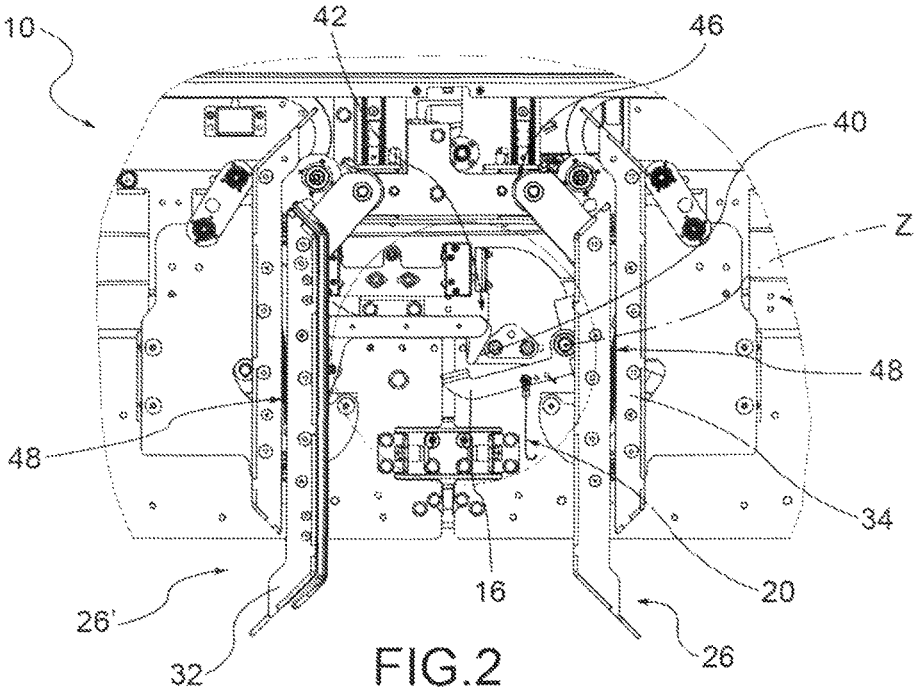
Figure 3:
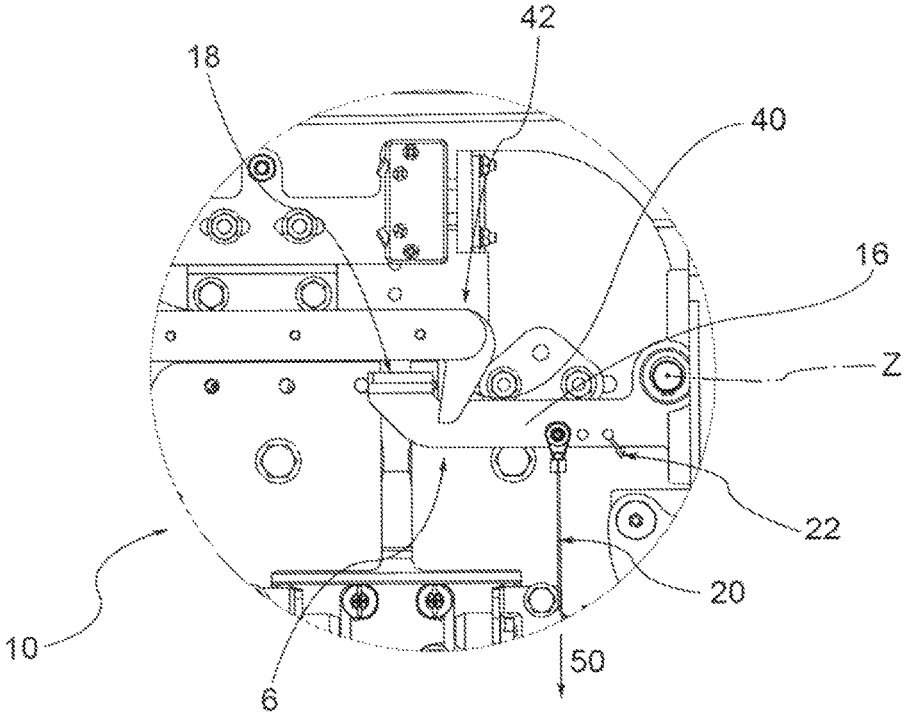
FIGS. 3 and 4 show magnifications of the areas highlighted, respectively, in FIG. 1 and in FIG. 2.

For example, with reference to the arrangement shown in FIGS. 1 and 2, pulling the manual actuating means 20 in the direction of the arrow 50 causes a downward rotation of the holding edge 8, which thereby frees the trajectory along which the latch moves.

According to a variant of particular advantage, when the latch 4 approaches the holding edge 8, the cam-shaped front surface 40 causes a deviation between the latch and the edge (and more precisely moves the edge away), and allows a subsequent engagement of the hooking portion 42 to the holding edge 8, in this case after the aforesaid hooking portion has slid over this edge.

In this way, even in the case in which the latch was brought close to the keyhole element in the locking configuration, the locking system would still be suitable to constrain the door, since the front surface 40 would cause the movement or rotation of the keyhole element and the engagement of the holding edge with the latch.

According to an embodiment, the locking system 10 comprises elastic return means 22 that constantly act on the keyhole member 6 and on the constraint structure, or on said member and on the sliding door 2, in an opposite direction to the direction of manual actuation of said member. For example, the elastic return means comprise a helical spring mounted coaxially to a pivot pin 52 that extends along the secondary rotation axis Z.

According to an advantageous embodiment, the keyhole member 6 or the holding edge 8 is rotatable by a maximum angle 24 equal to or of smaller than 20°, preferably equal to or smaller than about 15°.

Advantageously, the locking system and the assembly of this invention are implementable in any existing lift door, by virtue of the relative construction simplicity and reliability.

Advantageously, the locking system and assembly that are the object of this invention are designed to ensure reliable mechanical coupling in all circumstances.

Advantageously, the locking system that is the object of this invention is designed to perform movements with a low inertia.

Advantageously, the locking system that is the object of this invention is designed to perform accurately controlled maximum excursions.

Advantageously, the weight of the locking/unlocking trolley constitutes an additional security against possible and accidental unhooking of the latch.

To the embodiments of the aforesaid locking system and assembly a skilled person, in order to meet specific needs, may make variants or substitutions of elements with others functionally equivalent.

Even these variants are contained within the scope of protection, as defined by the following claims.

Moreover, each of the variants described as belonging to a possible embodiment can be realized independently of the other variants described.

The invention claimed is:

1. A locking system for a sliding door relative to a constraint structure, for example relative to a side post, to an opposite door, to a translation guide of said door or the like, said system comprising:

a latch, associable with the sliding door or with the constraint structure and rotatable about a primary rotation axis, or roto-translatable, between a locking configuration and a release configuration of said door;

a keyhole member, connectable to the other between the constraint structure or the sliding door, delimiting a holding edge that in the locking configuration is engaged by the latch to prevent the sliding door from moving relative to said structure; wherein the keyhole member is manually operable to distance the holding edge from the latch, when the latter is in the locking configuration.

2. The locking system of claim 1, wherein the keyhole member is rotatable relative to the constraint structure or relative to the sliding door, wherein one first arc trajectory of said member overlaps at least in projection a second arc trajectory travelled by the latch.

3. The locking system of claim 2, wherein the keyhole member is rotatable by a maximum angle equal to or smaller than 20°, preferably equal to or smaller than about 15°.

4. The locking system of claim 1, wherein the keyhole member is rotatably operable about a secondary rotation axis substantially parallel to said primary rotation axis.

5. The locking system of claim 1, wherein the keyhole member comprises a mobile/rotatable shaft at one end of which a transversal component is secured delimiting at least one part of the holding edge.

6. The locking system of claim 5, further comprising manual actuating means acting on the mobile/rotatable shaft to disengage the holding edge from the latch.

7. The locking system of claim 1, wherein the latch comprises a hooking portion and delimits a cam-shaped front surface that, when the latch and the holding edge approach, causes a displacement between said latch and said edge, and allows the hooking portion to subsequently hook to the holding edge.

8. The locking system of claim 1, further comprising elastic return means, constantly acting on the keyhole member and on the constraint structure, or on said member and on the sliding door, in an opposite direction to the direction of manual actuation of said member.

9. A locking assembly comprising:

at least one sliding door;

a constraint structure, in particular a side post, an opposite door, a translation guide of said door or the like; and a locking system according to claim 1, operatively connected to the sliding door and to the constraint structure.

10. The assembly of claim 9 further comprising:

at least one slide, translatably movable together with the sliding door and configured for cooperating with a lock of a landing door to allow an opening of the latter;

second moving means acting on a locking/unlocking trolley of said slide by means of a kinematic coupling of the irreversible type.

11. The assembly of claim 10, wherein the slide comprises a pair of slide blades that are movable towards and away from each other in an articulated manner, the movement of the latch being controlled by the movement of at least one of said blades.

12. The assembly of claim 10, wherein the latch and the keyhole member are secured at respective slides associated with adjacent doors.

13. The assembly of claim 10, further comprising first moving means, independent of the second moving means, to move the sliding door and the respective slide from an abutment position of the door with the side post or with the opposite door, to a separation position from said post or from said opposite door.

14. The assembly of claim 10, further comprising a pair of centrally-opening sliding doors, and a locking/unlocking trolley acting in parallel on the slide of each of said doors.

* * * * *